United States Patent [19]

Roesner et al.

[11] Patent Number: 4,507,552

[45] Date of Patent: Mar. 26, 1985

[54] METHOD AND APPARATUS FOR DETERMINING FLOW CHARACTERISTICS WITHIN A WELL

[75] Inventors: Raymond E. Roesner; Mark L. Sloan, both of Houston, Tex.

[73] Assignee: Dresser Industries, Inc., Dallas, Tex.

[21] Appl. No.: 410,276

[22] Filed: Aug. 23, 1982

[51] Int. Cl.[3] ..... G01V 5/00

[52] U.S. Cl. ..... 250/259; 73/155

[58] Field of Search ..... 250/256, 259, 260; 73/155

[56] References Cited

U.S. PATENT DOCUMENTS

| | | | |
|---|---|---|---|
| 3,343,408 | 9/1967 | Mayer, Jr. | 73/155 |
| 3,431,974 | 3/1969 | Buck et al. | 73/155 |
| 3,766,388 | 10/1973 | Greaney | 250/266 |
| 4,166,215 | 8/1979 | Anderson | 250/260 |
| 4,166,216 | 8/1979 | Cubberly, Jr. | 250/260 |

*Primary Examiner*—Janice A. Howell
*Attorney, Agent, or Firm*—Patrick H. McCollum; Richard M. Byron

[57] ABSTRACT

In the representative embodiments of the new and improved methods and apparatus disclosed herein, a well logging instrument includes an elongated body member having a funnel configuration fluid collector mounted thereon. An aperture in the body member, proximate the apex of the collector, allows discharge of the fluid through a passage in the body member, past a pair of radiation detectors, thereafter returning into the well. A tracer ejector valve assembly is mounted proximate the apex of the funnel and the aperture therein for selectively injecting a quantity of radioactive tracer element into the fluid flow. The tracer element is detected by the pair of detectors with the signals provided therefrom used to determine flow characteristics of the fluids within the well.

11 Claims, 8 Drawing Figures

FIG. 2F
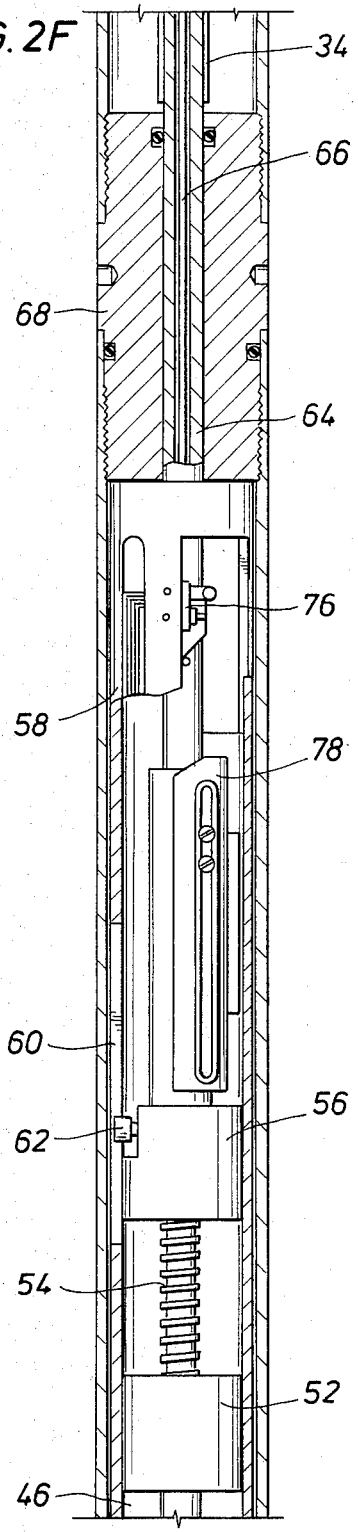
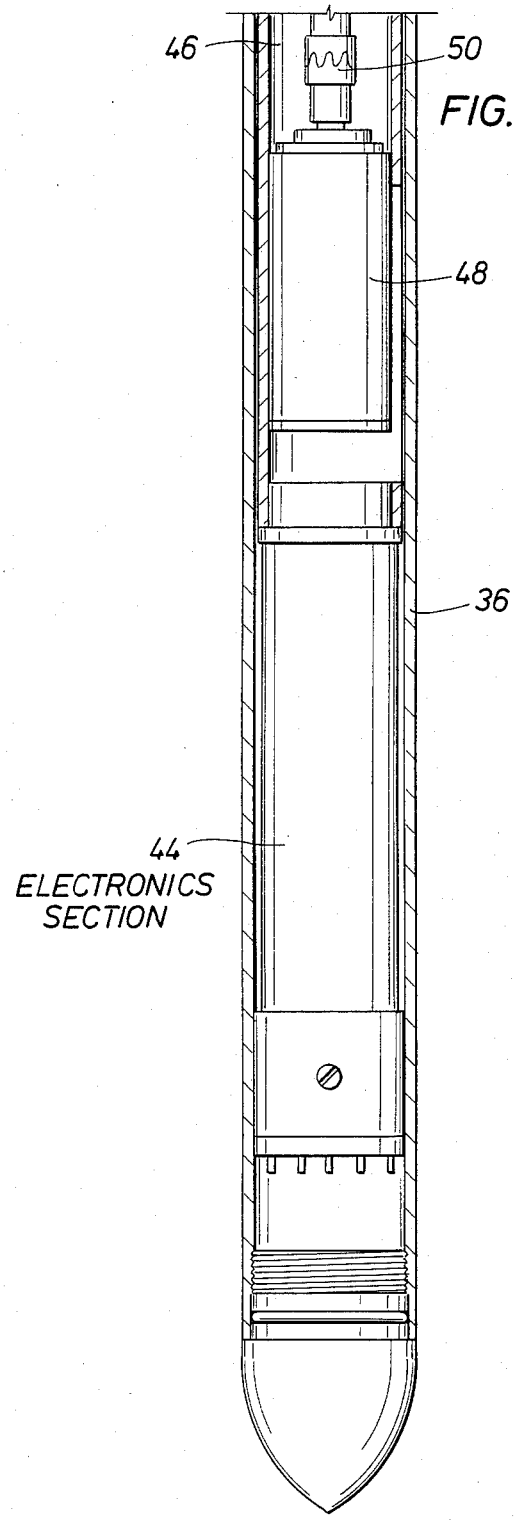
FIG. 2G

METHOD AND APPARATUS FOR DETERMINING FLOW CHARACTERISTICS WITHIN A WELL

BACKGROUND OF THE INVENTION

This invention relates generally to methods and apparatus for well logging and more specifically relates to methods and apparatus for injecting a radioactive tracer element into the fluid flow within a well to assist in the determination of parameters concerning the movement of such fluid flow.

Wells drilled for use in the production of oil or gas may be utilized either as producing wells, from which the oil or gas is obtained, or as injection wells, through which fluids, such a polymer compounds, are forced into the earth formations surrounding the well to force the oil or gas through the formations to thereby stimulate production in nearby wells. Wells may often be drilled as producing wells and subsequently converted to use as injection wells when such change in usage becomes economically preferable.

In a producing well, the oil or gas may enter the well from one or more depth horizons or zones within the earth formations surrounding the well. When the oil or gas is being produced from more than one zone it is desirable to determine how much of the fluid is being produced from each zone. This determination may be made by measuring the velocity of the well fluid at various depth locations within the well, preferably at locations between the known producing zones. From such fluid velocity measurements and knowledge of both the diameter of the well at each depth location and of the diameter of the logging instrument used to measure the fluid velocity, the volumetric flow rate of the well fluid at each depth location may be determined, thereby facilitating a determination of the proportional contribution of each producing zone to the total flow rate of the well.

An analogous but reverse situation is presented in the case of injection wells. When polymers, or other fluids are being injected, or pumped, into the well, it is desirable to determine the proportion of the injection fluid which is entering each zone within the well so as to determine if the desired zones are receiving the injection fluid. By measuring the velocity of the injection fluid and by determining the fluid flow rate therefrom at various depth locations within the well, the proportion of the injection fluid entering each zone may be determined.

One means which has been utilized by the oil and gas industry to make such fluid velocity measurements, and in turn such flow rate determinations, has been to inject a tracer element, such as a radioactive isotope, into a well fluid flow and to measure the time required for the tracer element to traverse a known distance within the well. In the case of a radioactive tracer this may be accomplished by injecting the tracer element from a logging instrument upstream in the fluid flow from a pair of suitable radiation detectors, such as Geiger counter tubes or scintillation counters, spaced a known fixed distance apart along the longitudinal axis of the logging instrument. The time between the passing by the tracer element of the first detector to the passing of the second detector may then be utilized to determine the velocity of the well fluid. Apparatus commonly used in the oil and gas industry for injecting tracer elements into the well fluid flow have typically ejected the tracer element in a generally lateral direction relative to the longitudinal axis of the well bore, such ejection typically being accomplished by forcing the tracer element through one or more jets or nozzles located on the periphery of a logging instrument. This method of tracer ejection has been found to be unsuited for use in production wells with relatively low flow rates, rates less than 300 barrels per day and/or in injection wells using relatively high viscosity fluids, such as polymers. In these types of wells the tracer element ejected from an instrument tends to be propelled across the dimension of the well and to become stuck to the side of the well. Additionally, the low fluid flow rates tends to allow the tracer material to be dispersed within the fluid flow, or to form an elongated bubble of tracer material, making accurate detection difficult.

Accordingly, the present invention overcomes the deficiencies of the prior art by providing a method and apparatus whereby tracer elements may be accurately and repeatedly placed in a desired proportional location across the fluid flow column within a well and by which characteristics of the movement of such fluid may be determined.

SUMMARY OF THE INVENTION

A tracer ejector instrument adapted to place a quantity of a tracer element into the fluid flow includes an elongated body member having a funnel configuration adapted thereto. The funnel collects and accelerates the fluid flow which is discharged through an aperture located proximate the apex of the funnel into a fluid passage within the body member. Mounted proximate the apex of the funnel is a tracer ejector valve assembly coupled by a fluid passage to a tracer element storage chamber contained within the body member. A piston in the chamber is controllably moved therein by a drive mechanism responsive to electrical command signals from control circuitry located at the earth's surface. As the piston moves within the chamber a quantity of tracer element contained therein is forced through a fluid passage and the ejector valve assembly, overcoming the forward flow release pressure thereof, and is ejected into the fluid flow. The fluid and tracer material flow through the fluid passage past a spaced-apart pair of radiation detectors and are expelled into the well. The detector signals are used to determine the velocity of the tracer material and thus of the well fluid.

BRIEF DESCRIPTION OF THE DRAWINGS

FIGS. 2A–F comprises a side view, partially in cross-section of the tracer injector of the instrument of FIG. 1.

DETAILED DESCRIPTION OF THE PREFERRED EMBODIMENT

Figure 1:
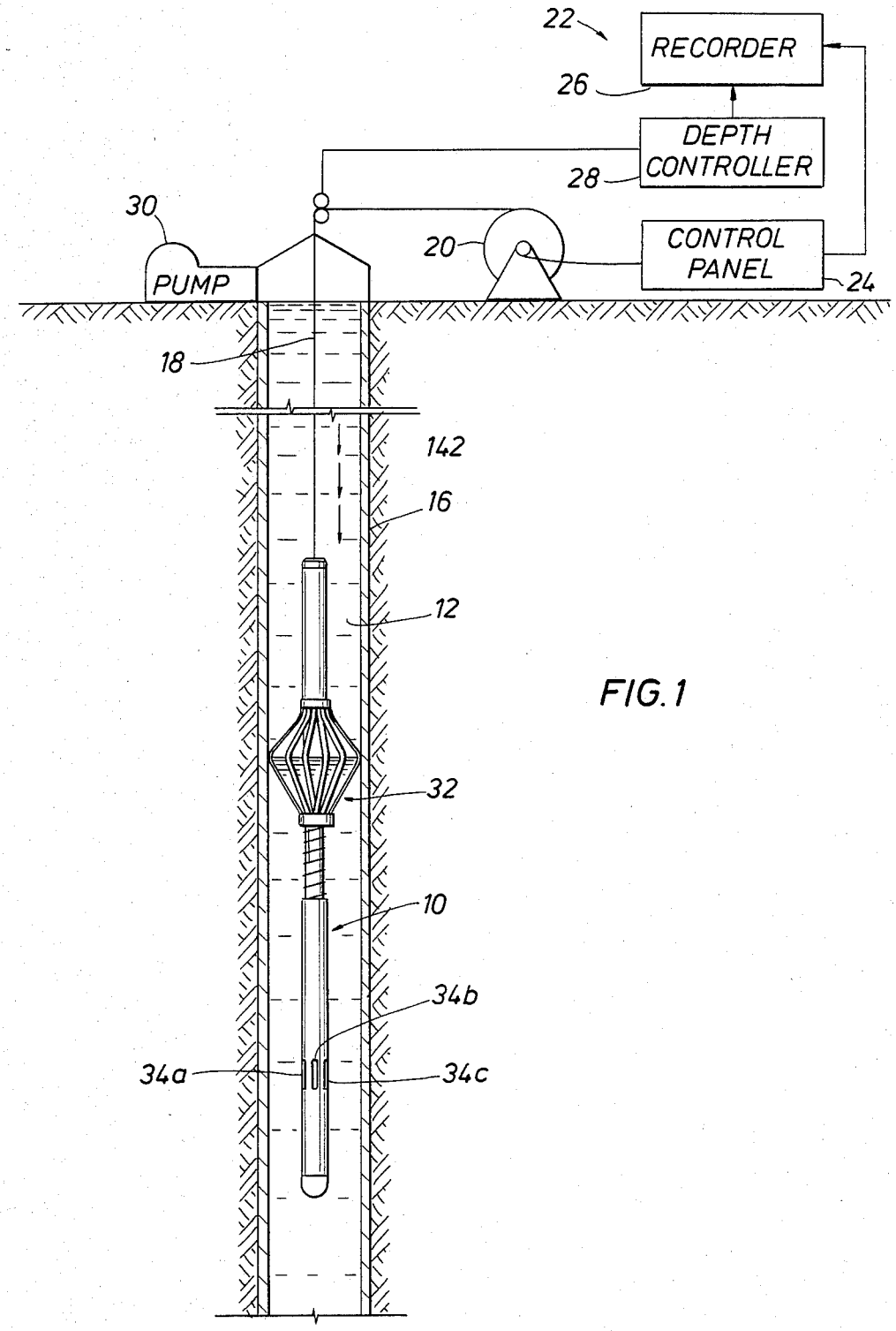
FIG. 1 is a side view of an instrument for determining fluid flow characteristics within a well in accordance with the present invention, in an intended operating configuration, shown disposed within a well, illustrated in vertical section.
Figure 2A:
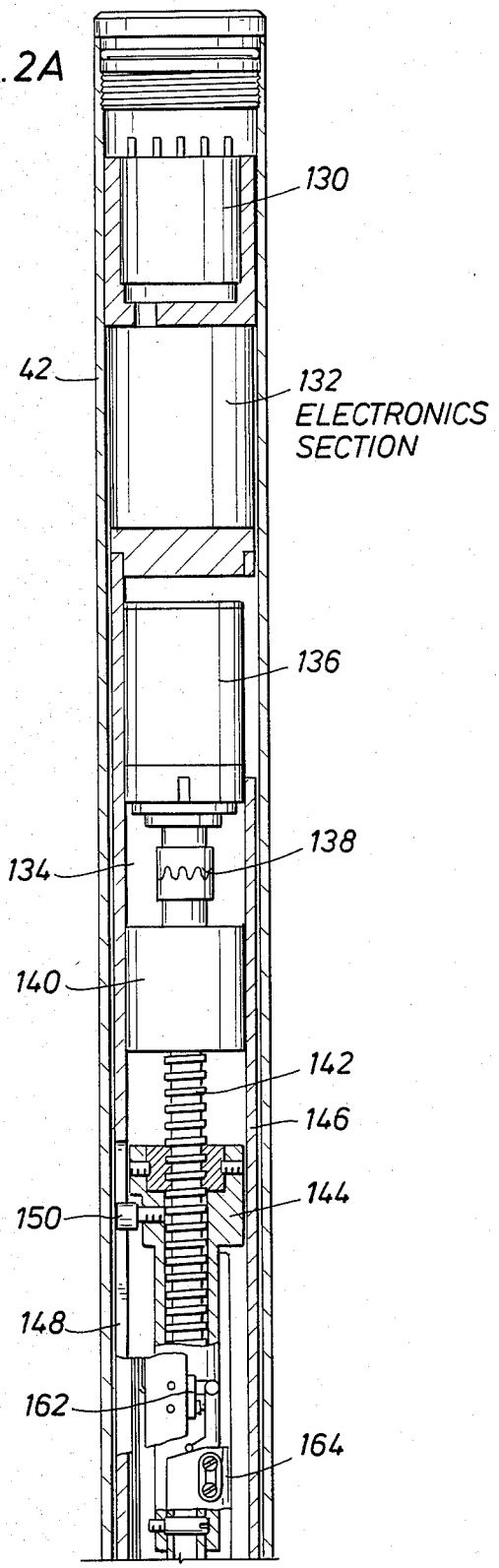
Figure 2B:
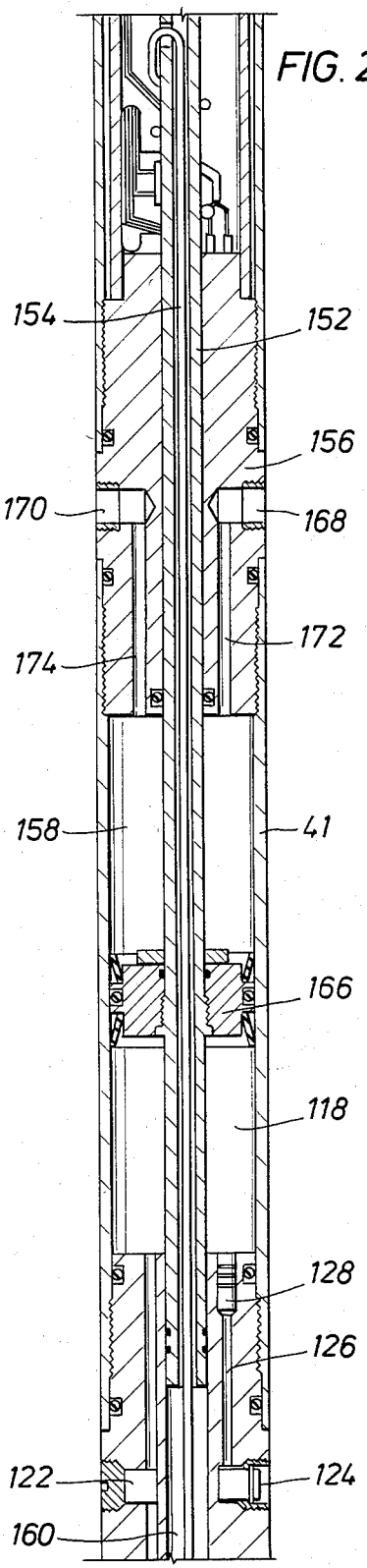
Figure 2C:
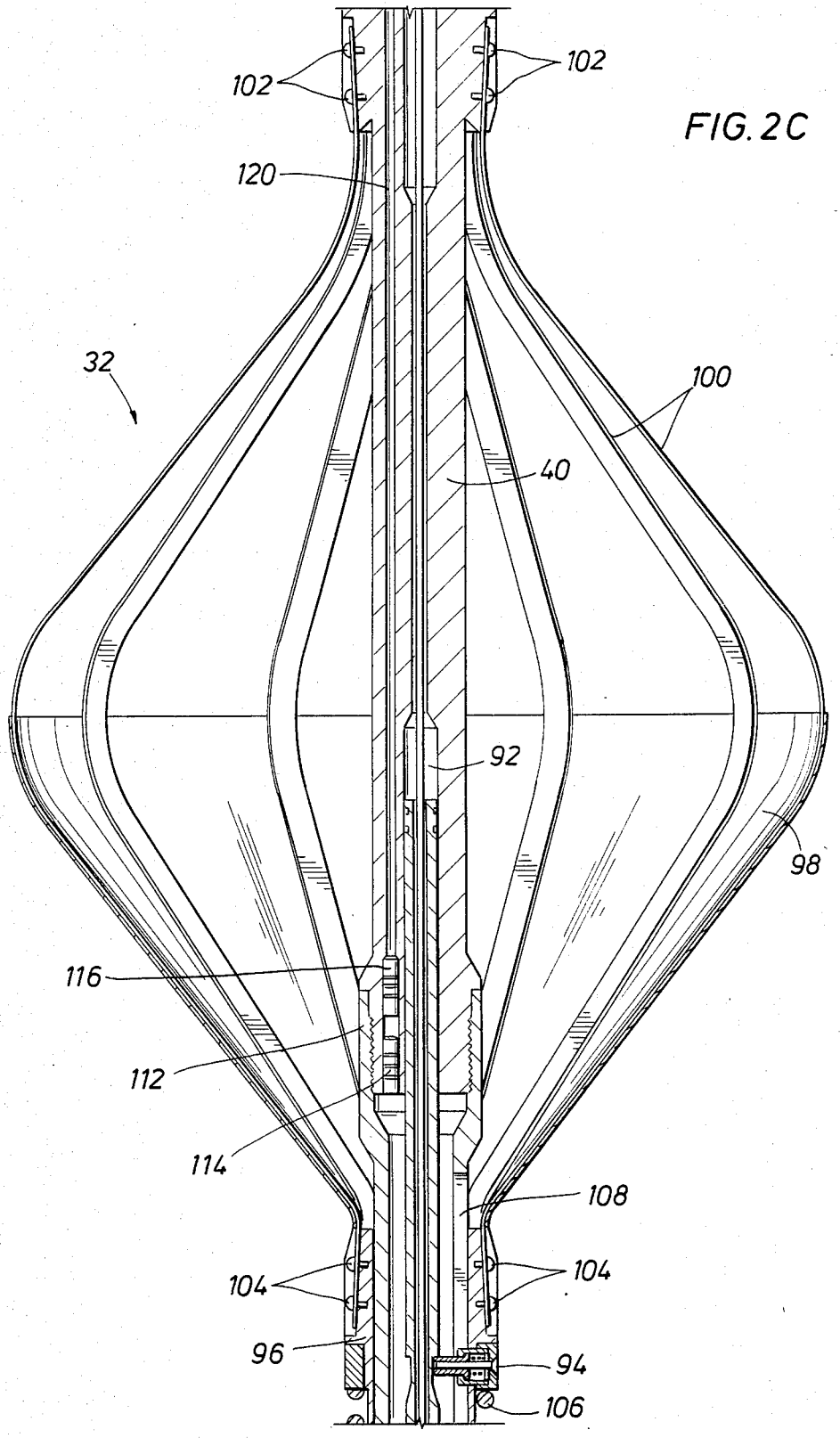
Figure 2D:
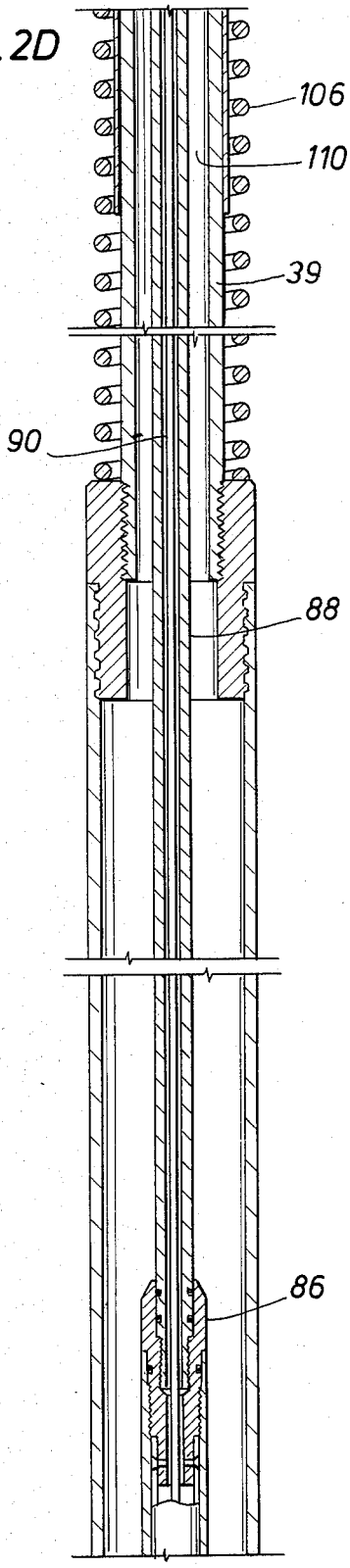
Figure 2E:
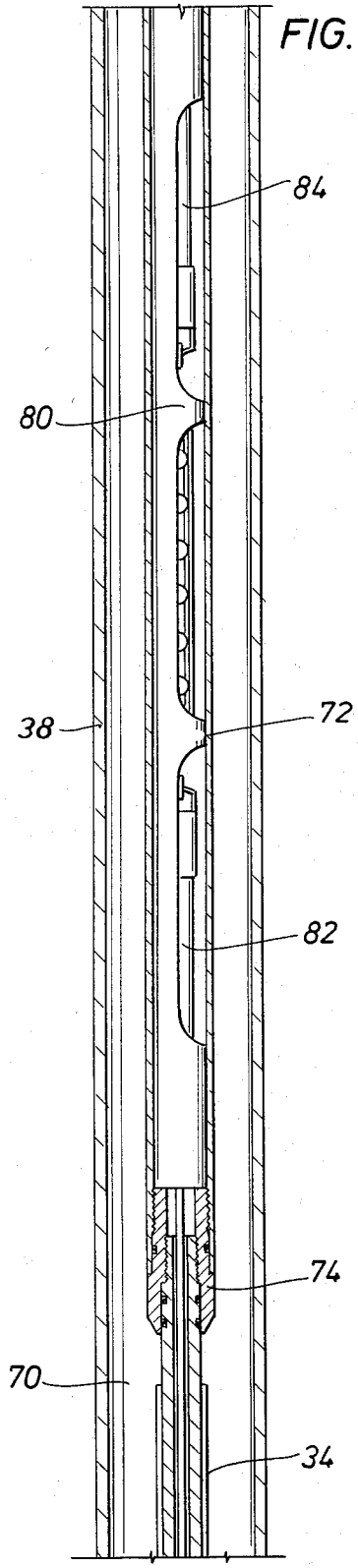

Referring now to the drawings in more detail, particularly to FIG. 1, therein is illustrated instrument 10 in accordance with the present invention, disposed within a borehole or well 12 penetrating a portion of the earth formations 14, illustrated in vertical section. Although a well 12 in which casing 16 has been set in place is illustrated, it is to be understood that an instrument in accordane with the present invention may be employed in an uncased well. Instrument 10 is suspended within well 12 by cable 18 which contains electrical conductors for providing electrical communication between instrument 10 and the required operating equipment located at the earth's surface, illustrated generally at 22.

Surface electronics 22 includes control panel 24 containing electronic circuitry suitable for generating command signals as required to operate instrument 10 and for processing signals sent to the surface from instrument 10. These processed signals can then be recorded on recorder 26. As instrument 10 is caused to traverse well 12, by winding cable 18 on or unwinding cable 18 from drum 20, depth controller 28 measures the movement of cable 18 and generates electrical signals representative of the movement which are coupled into recorder 26. Thus, the recording of data represented by the electrical signals from control panel 24 can be recorded as a function of the longitudinal location within the well at which the data is generated.

Illustrated at the earth's surface is pump 30 as utilized in an injection well where fluids are pumped into well 12 in an effort to stimulate production in other nearby wells. Because of the downward flow of injection fluids instrument 10 is illustrated as being disposed within well 12 in a manner such that the large open area of collector 32 opens towards the top of well 12. Fluids entering collector 32 will traverse through fluid passages within instrument 10 re-entering well 12 through apertures 34. However, it is to be understood that should well 12 be a producing well having upward fluid flow instrument 10 would be inserted into well 12 longitudinally reversed from the illustrated position.

Referring now to FIGS. 2A–F of the drawings, therein is illustrated instrument 10 in greater detail and partially in cross-section. Instrument 10 includes an elongated housing composed of housing members 36, 38, 39, 40, 41 and 42 suitably coupled together to form the elongated housing and designed to withstand the thermal and pressure environments encountered in a well. Contained within housing 36, proximate one end therof, is electronics section 44 containing such power supplies and switching circuits as necessary to control and operate first drive assembly 46 in response to electrical command signals generated by the surface instrumentation.

First drive assembly 46 operates to selectively expand and retract collector 32 in relation to body member 40 and may be of any suitable type common in the art. Preferably first drive assembly 46 is an electro-mechanical system which includes a reversible electric motor 48 connected through coupling 50 to gear box 52. Gear box 52, which can be a bearing assembly, serves to rotate drive screw 54 to move screw follower 56 longitudinally within body member 36. The operational components of first drive assembly 46 are adaptively mounted within inner frame or tube 58 having a longitudinal recess or slot 60 formed therein. Guide member 62 is coupled to screw follower 56 and slidably engaged within slot 60, thereby restricting the movement of screw follower 56 to translation within body member 36.

Coupled to screw follower 56 is one end of push/pull rod member 65. Rod 64 comprises an elongated member, having a longitudinal passage 66 therethrough, and extends from screw follower 56 through coupling sub 68 into chamber 70, within housing member 38, where the second end of rod 64 is mechanically coupled to detector housing 72 by coupling 74. Mounted on frame 58 is electrical limit switch 76. Switch 76 is acutated by engagement with switch actuator 78 caused by translation of screw follower 56, to which actuator 78 is attached, within housing 36. Limit switch 76 removes electrical power from motor 48 when activated by switch actuator 78 thereby placing a maximum limit on the expandability of collector 32. Passage 66 traversing rod 64 exits proximate switch 76 and contains the required electrical conductors for providing connection with electronics section 44.

Detector housing 72 contained within chamber 70 comprises an elongated tubular member functioning as a push/pull member for opening and closing collector 32 and as a housing for the radiation detector assembly. The detector assembly includes chassis member 80 upon which are mounted a pair of radiation detectors 82 and 84, preferably having a spacing of approximately 12 inches between centers thereof. Detectors 82 and 84 are of a type suitable for detecting the tracer element utilized and to generate signals representative of such radiation. Detectors 82 and 84 can be any suitable scintillation counters or Geiger counter tubes, preferably Geiger counter tubes. Detectors 80 and 82 are electrically coupled to suitable electronics circuitry located either within instrument 10 or in control panel 24.

The second end of detector housing 72 is mechanically coupled by coupling member 86 to a first end of push/pull rod 88. Rod 88 is an elongated rod member, having a longitudinal passage 90 therethrough for containing electrical conductors, the second end of which extends into and is slidable within bore 92 within housing member 40. Slidably mounted on housing member 39 and affixed by suitable means such as screw 94 to rod 88 is collar 96 to which is attached one end of collector 32. In the preferred embodiment collector 32 comprises a plurality of deflector springs, illustrated generally at 98, disposed essentially equidistant around the periphery of body member 40. Each deflector spring is comprised of an elongated bow spring 100 with a deflector fin affixed thereto. The deflector fins are interlayed with one another to form a funnel-like arrangement. In the preferred embodiment there will be from between ten to fourteen of these deflector springs. Each spring has a first end fixedly attached to body member 40, by means such as screws 102, and a second end attached to slide collar 96, by means such as screws 104. Activation of first drive assembly 46 results in slidable movement of collar 96 on body member 39 thereby causing opening or closing of collector 32. When in an open position collar 96 is biased by helical spring 106. A more detailed description of the collector apparatus of the present invention can be had by reference to U.S. patent application Ser. No. 369,945, 4/19/82, now U.S. Pat. No. 4,441,362, issued 4/10/84 which is incorporated herein by reference.

Located within body member 39 proximate the apex of collector 32 is aperture 108 connecting to fluid passage 110. Fluid passage 110 traverses longitudinally through body member 39 connecting to chamber 70 within body member 38. Chamber 70 fluidly communicates with the well through apertures 34 located in body member 38. Also located proximate the apex of collector 36 and proximate aperture 108 is tracer ejector valve assembly 112. Valve assembly 112 is aligned parallel to the longitudinal axis of instrument 10 so that tracer elements can be ejected therefrom in the direction of fluid flow through aperture 108 into passage 110. Valve assembly 112 includes first check valve 114 and second check valve 116 serially connected. In the preferred embodiment first check valve 114 has a forward flow release pressure from between 2–5 psig and second check valve 116 has a forward flow release pressure of 40 psig.

Ejector valve assembly 112 is fluidly coupled to tracer fluid chamber 118 within body housing 41 by fluid passage 120. Dispose within fluid passage 120 intermediate chamber 118 and valve assembly 112 is filter 122. To provide filling of chamber 118 with suitable tracer elements there is provided filler/flusher port 124 connected to chamber 118 by fluid passage 126 and check valve 128. Check valve 128 preferably has a forward flow release pressure from between 2–5 psig.

Turning now to the components contained within housing 42, proximate one end thereof is electrical contact assembly 130 connected to electronics section 132 containing such power supplies and switching circuits as necessary to control and operate second drive assembly 134 in response to electrical command signals generated by the surface instrumentation. Second drive assembly 134 operates to selectively eject tracer elements from tracer chamber 118 through passage 120 and ejector valve assembly 112. Preferably second drive assembly 134 is an electromechanical system which includes a reversible electric motor 136 connected through coupling 138 to gear box 140. Gear box 140 serves to rotate drive screw 142 to move screw follower 144 longitudinally within body member 42. The operational components of second drive assembly 134 are adaptively mounted within inner frame or tube 146 having a longitudinal recess or slot 148 formed therein. Guide member 150 is coupled to screw follower 144 and slidably engaged within slot 148, thereby restricting the movement of screw follower 144 to translation within body member 42.

Coupled to screw follower 144 is one end of push-/pull rod member 152. Rod 152 comprises an elongated member, having a logitudinal passage 154 therethrough, and extends from screw follower 144 through coupling sub 156, pressure balance chamber 158, and tracer fluid chamber 118 with the second end of rod 152 slidably retained within bore 160. Mounted on frame 146 is electrical limit switch 162. Switch 162 is activated by engagement with switch acutator 164 caused by translation of screw follower 144, to which switch acutator 164 is attached, within housing 42. Passage 154 traversing rod 152 enters proximate the first end thereof and contains the required electrical conductors for providing connection with detector 82 and 84 and electronics section 44.

Fluid chamber 158 is fluidly isolated from tracer fluid chamber 118 by isolation piston 166. Fluid chamber 158 is in fluid communication with the well by ports 168 and 170 and fluid passages 172 and 174. Thus, well fluid at well pressure enters chamber 158 by way of ports 168 and 170 and passages 172 and 174 to exert hydrostatic pressure on piston 166.

Referring now to the figures generally, in the operation of the apparatus of the present invention, prior to insertion of instrument 10 into a well, fluid chamber 118 thereof is filled with a radioactive tracer element, such as, for example iodine-131 or iridium-192. To fill chamber 118, second drive assembly 134 is activated by means of electrical command signals from electronics section 132 to motor 136, causing piston 166 to move longitudinally, expanding chamber 118 and reducing the effective size of chamber 158. A column of tracer element is placed above fill port 124 while second drive assembly 134 is activated thereby drawing the tracer element into chamber 118. To prepare instrument 10 for insertion into well, first drive assembly 46 is activated to draw screw follower 56 longitudinally within housing 36 thereby closing collector 32 about body member 40.

Instrument 10 is attached to cable 18 and lowered into well 12 to a depth horizon at which fluid flow measurements are desired. It should be appreciated that when fluid flow measurements are desired in a production well, instrument 10 will be suspended from cable 18 by attachment of cable 18 to the end illustrated proximate electronics section 44, with collector 32 opening towards the bottom of well 12, and conversely when fluid flow measurements are desired in an injection well instrument 10 will be suspended from cable 18 by attachment of cable 18 to the end proximate electronics section 132, with collector 32 opening towards the top of well 12. When instrument 10 is positioned within well 12 a first command signal is generated by control panel 24 to activate first drive assembly 46 to move push/pull rod 64, detector housing 72 and push/pull rod 88, with slidable collar 96 attached thereto, thereby causing deflector springs 98 to form a tapered collector 32. As collector 32 is expanded and formed, preferably to the approximate diameter of well 12, collector 32 virtually blocks the fluid flow around instrument 10, channeling the majority of the flowing fluids toward aperture 108 proximate the apex or throat of collector 32. If will be recognized that as the inner diameter of collector 32 narrows, due to the substantially constant flow rate of the well fluid, the linear velocity of the fluid flowing through collector 32 increases significantly. Thus instrument 10 finds particular utility in low flow rate production wells, below approximately 300 barrels per day, and in polymer injection wells using high viscous compounds, such as polymers.

The fluid mixture travels through aperture 108 and fluid passage 110 into chamber 70, exiting chamber 70 through apertures 34 returning into well 12. In making a fluid flow measurement, a second electrical command signal is generated by control panel 24, activating second drive assembly 134 for an established time increment. Motor 136 moves push/pull rod 152, moving piston 166, reducing the area of tracer fluid chamber 118. As piston 166 compresses the tracer element within chamber 118 the pressure upon the tracer element builds until the forward flow release pressure of ejector valve assembly 112 is achieved, whereupon tracer element will flow through passage 120 and ejector valve assembly 112 and be injected into the fluid flow in the direction of flow and substantially parallel to the longitudinal axis of instrument 10. As piston 166 moves to reduce the capacity of chamber 118 well fluid will be drawn into chamber 158 through ports 168 and 170 and passages 172 and 174, thereby providing pressure balancing with the well.

As previously mentioned, a quantity of tracer element is ejected from valve assembly 112 in a direction corresponding to the direction of fluid flow into aperture 108 and passage 110. The fluid and tracer element flows through passage 110 into chamber 70, past detectors 82 and 84 and re-enters well 12 through apertures 34. As tracer element passes the detectors 82 and 84 its presence in the fluid flow is detected and translated into electrical signals which can be processed to determine the effective flow rate of the fluids within the well.

When second drive assembly 134 is deactivated, due to termination of the activation signal, the pressure build-up on the tracer element stops, allowing first and second check valves 114 and 116 re-seat. Two series check valves are employed to provide a substantially drip-free cutoff of ejector valve assembly 112. Once fluid flow measurements are complete at a particular depth horizon, first drive assembly 46 is activated in the reverse direction from the last employed so as to retract collector 32 about body member 40. Instrument 10 may then be relocated within well 12 or removed therefrom.

Many modifications and variations besides those specifically mentioned may be made in the techniques and structures described herein and depicted in the accompanying drawings without departing from the concept of the present invention. Accordingly, it should be clearly understood that the forms of the invention described and illustrated are exemplary only and are not intended as limitations on the scope of the present invention.

The embodiments of the invention in which an exclusive property or privilege is claimed are defined as follows:

1. A well logging apparatus for determining characteristics of fluid flow within a well, comprising:

a body member adapted to traverse a well;

means mounted on said body member for collecting and accelerating along a defined flow path at least a portion of the fluid flow within said well;

means for releasing a quantity of tracer element into and parallel with said collected and accelerated fluid flow; and means for detecting said tracer element along said defined flow path.

2. The well logging apparatus of claim 1, wherein said collecting and accelerating means comprises a tapered collector intersecting at least a portion of said fluid flow, said collector having at least one aperture proximate the apex thereof for discharging said fluid flow along said defined flow path.

3. The well logging apparatus of claim 2, wherein said defined flow path comprises a fluid passage located within said body member.

4. The well logging apparatus of claim 1, wherein said releasing means comprises:

tracer-ejecting means having at least one tracer-discharge opening aligned along a discharge axis substantially parallel to the longitudinal axis of said body member; and selectively-operable tracer supply means coupled to said tracer-ejecting means.

5. The well logging apparatus of claim 4, wherein said tracer-ejecting means comprises first and second serially connected value means.

6. The well logging apparatus of claim 1, wherein said detecting means comprises a pair of spaced apart radiation detectors mounted within said defined flow path.

7. Apparatus for releasing a fluidic tracer element into fluid flow within a well having relatively low flow rates, comprising:

an elongated body member adapted to traverse a well;

a generally tapered fluid-diverting means cooperatively arranged on said body member for collecting and accelerating, along a defined path, at least a portion of the fluid flow within said well;

ejecting means cooperatively arranged on said body member within said fluid-diverting means for releasing a quantity of tracer element into and parallel with said accelerated fluid flow in said defined path; and detecting means cooperatively arranged within said body member, along said defined path, for detecting said tracer element and producing an output signal representative thereof.

8. The apparatus of claim 7, wherein said ejecting means comprises:

tracer-ejecting valve means having a discharge opening aligned along a discharge axis substantially parallel to the longitudinal axis of said elongated body member; and selectively-operable tracer supply means fluidly coupled to said tracer-ejecting means.

9. The apparatus of claim 8, wherein said tracer-ejecting valve means comprises:

a first check valve having a first forward flow release pressure; and a second check valve having a second forward flow release pressure, said second check valve serially connected with said first check valve.

10. The apparatus of claim 9, wherein said detecting means comprises a pair of radiation detectors in spaced relation within said defined flow path.

11. The apparatus of claim 10, wherein said defined flow path is located within said elongated body member from approximately a position proximate the apex of said tapered fluid-diverting means to a position along said body member past said radiation detectors.

* * * * *